US006709515B2

(12) United States Patent
Kodou et al.

(10) Patent No.: US 6,709,515 B2
(45) Date of Patent: Mar. 23, 2004

(54) GRAVURE COATING APPARATUS

(75) Inventors: Atsushi Kodou, Fujinomiya (JP); Shuuichi Endo, Fujinomiya (JP); Matsutaro Hirose, Fujinomiya (JP); Daisuke Sano, Fujinomiya (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/327,926

(22) Filed: Dec. 26, 2002

(65) Prior Publication Data

US 2003/0121471 A1 Jul. 3, 2003

(30) Foreign Application Priority Data

Dec. 28, 2001 (JP) ..... 2001-398725

(51) Int. Cl.[7] ..... B05C 1/08

(52) U.S. Cl. ..... 118/211; 118/212; 118/249; 118/259; 118/410; 118/DIG. 4; 101/153

(58) Field of Search ..... 118/211, 212, 118/249, 259, 410, DIG. 4; 427/428, 420; 101/153; 162/134

(56) References Cited

U.S. PATENT DOCUMENTS 2,711,132 A * 6/1955 Viscardi ..... 101/170
3,304,861 A * 2/1967 Magid ..... 101/152
3,814,052 A * 6/1974 Caratsch ..... 118/60
5,681,389 A * 10/1997 Lobo et al. ..... 118/212

FOREIGN PATENT DOCUMENTS

JP 63-194766 8/1988

* cited by examiner

*Primary Examiner*—Laura Edwards
(74) *Attorney, Agent, or Firm*—Young & Thompson

(57) ABSTRACT

In the gravure coating apparatus, while a bead portion of a coating liquid is formed between a roll surface of a gravure roll to which the coating liquid is excessively supplied and a web that runs continuously, the web is pressed on the gravure roll by using a backup roll, whereby a desired amount of the coating liquid is applied to the web, a liquid supply device having an inclined surface that is inclined downward toward the roll surface and a gap too narrow for the coating liquid to flow down between the roll surface and the inclined surface is provided at a position near the bead portion on the upstream side in the direction of rotation of the gravure roll so that the coating liquid flows down on the inclined surface and is supplied to the gravure roll. A liquid return of an excess coating liquid that is not used for coating in the bead portion is less liable to occur, so that a streak trouble on a coating surface formed on the web can be prevented from occurring.

17 Claims, 4 Drawing Sheets

GRAVURE COATING APPARATUS

BACKGROUND OF THE INVENTION

1. Field of the Invention

The present invention relates to a gravure coating apparatus, and more particularly to a gravure coating apparatus for applying a coating liquid to a flexible substrate (hereinafter referred to as a "web") which runs continuously, the gravure coating apparatus being of a type such that no doctor blade is used.

2. Description of the Related Art

One of coating apparatuses for applying a coating liquid to a continuously running web is a gravure coating apparatus. In gravure coating, an excess amount of coating liquid supplied to a gravure roll so as to exceed a desired amount of coating liquid is usually scraped off by a doctor blade. When the doctor blade is used, however, the coating liquid forms a thin film at a coating point at which the gravure roll comes into contact with a backup roll via the web, so that a coating liquid surface in a cell of the gravure roll is liable to become of a concave shape. This presents a drawback in that the coating film applied to the web sometimes becomes irregular. To eliminate this drawback, a gravure coating apparatus without the use of a doctor blade has been contrived.

FIG. 3 shows a general construction of a conventional gravure coating apparatus without any use of a doctor blade. As shown in FIG. 3, in this gravure coating apparatus, a gravure roll 3 whose lower part is immersed in a coating liquid 2 in a liquid pan 1 is rotated to take up the coating liquid 2 from the liquid pan 1, by which the coating liquid 2 is supplied to the gravure roll 3. On the other hand, a continuously running web 4 is pressed on the gravure roll 3 by using a backup roll 6 while forming a bead portion 5 between the gravure roll 3 and the web 4, by which a desired amount of coating liquid 2 is applied to the web 4.

In the case where the gravure coating apparatus without any use of a doctor blade as described above, steady formation of bead is important for forming a satisfactory coating surface shape. For this purpose, it is necessary to excessively supply the coating liquid more than the desired coating amount to the bead portion 5. The excess coating liquid 2 that is not used for coating in the bead portion 5 flows in the direction reverse to a direction of rotation of the gravure roll 3 as a liquid return. As shown in a schematic view of FIG. 4, this liquid return forms a streak-shaped flow depending on the physical properties of the coating liquid 2 and coating speed, which poses a problem in that a streak trouble is caused on the coating surface on the web 4 due to the liquid return. Specifically, if a streak-shaped liquid return occurs, a flow in the widthwise direction is created in the bead portion 5, so that variation of size of the bead portion 5 is formed. As a result, when the web 4 is pressed on the gravure roll 3 by the backup roll 6, a force applied to the coating liquid 2 becomes nonuniform, so that unevenness of film thickness is caused on the web 4, causing the streak trouble.

As countermeasures against the streak trouble caused by the streak-shaped liquid return, Japanese Patent Application Publication No. 63-194766 discloses a method in which the coating liquid taken up from a liquid pan is brought up to the coating portion along a coating liquid guide plate, and an excess coating liquid is discharged through an excess liquid discharge guide surface, by which the liquid return flowing the roll surface is prevented.

However, in the countermeasure method disclosed in Japanese Patent Application Publication No. 63-194766, although no liquid return occurs on the roll surface of gravure roll, the coating liquid flowing along the excess liquid discharge guide surface becomes of a streak shape, which exerts an influence on the bead portion as well, so that the streak trouble is caused.

Therefore, in the conventional gravure coating apparatus of a type such that no doctor blade is used, it is an actual situation that any streak trouble cannot be solved radically.

SUMMARY OF THE INVENTION

The present invention has been achieved in view of the above situation, and accordingly an object thereof is to provide a gravure coating apparatus in which a streak trouble can be prevented from being caused on a coating surface on a flexible substrate because a liquid return of excess coating liquid that is not used for coating at a bead portion is less liable to occur.

To attain the above-described object, the present invention is directed to a gravure coating apparatus in which while a bead portion of a coating liquid is formed between a continuously running flexible substrate and a roll surface of a gravure roll to which the coating liquid more than a desired coating amount is excessively supplied, the flexible substrate is pressed on the gravure roll by using a backup roll, whereby the desired amount of coating liquid is applied to the flexible substrate, wherein a liquid supply device is provided at a position near the bead portion on an upstream side in a direction of rotation of the gravure roll to supply the coating liquid from the liquid supply device to the gravure roll.

The inventor paid attention to the fact that a force by which an excess coating liquid that is not used for coating in the bead portion is pulled in the direction reverse to the direction of rotation of roll under gravity is strong, and as the distance increases, a streak-shaped liquid return is liable to occur, and obtained a knowledge that the coating liquid is not supplied to the gravure roll by scraping the coating liquid from a liquid pan as before, but the coating liquid is supplied to a position near the bead portion on the upstream side in the direction of rotation of the gravure roll, by which the liquid return can be inhibited, so that even if the liquid return occurs, a streak-shaped liquid return can be prevented from occurring.

According to the present invention, the liquid supply device is provided at a position near the bead portion on the upstream side in the direction of rotation of the gravure roll to supply the coating liquid from the liquid supply device to the gravure roll. Therefore, even if a liquid return of excess coating liquid that is not used for coating in the bead portion is going to occur, the liquid return is blocked by the liquid supply device at a position near the bead portion, so that the liquid return in the direction reverse to the direction of rotation of the roll is less liable to occur. Therefore, the force by which the excess coating liquid is pulled in the direction reverse to the direction of rotation of roll under gravity can be weakened. Further, by supplying the coating liquid to a position near the bead portion, the coating liquid is made in a state of riding on the upper face of the roll surface and is less liable to flow down, which makes the liquid return more difficult to occur. Thereby, the occurrence of streak-shaped return liquid can be prevented effectively, so that a streak trouble can be prevented from being caused on the coating surface formed on the flexible substrate.

Also, as a preferred mode of the present invention, it is preferable that the liquid supply device has an inclined surface that is inclined downward toward the roll surface of the gravure roll to supply the coating liquid by causing the coating liquid to flow down on the inclined surface, and also has a gap larger than 0 μm and not larger than 400 μm between the tip end of the inclined surface and the roll surface. By causing the coating liquid to flow down on the inclined surface, the coating liquid can be supplied stably to the roll surface, and by forming the gap larger than 0 μm and not larger than 400 μm between the tip end of the inclined surface and the roll surface, the tip end of the inclined surface does not come in contact with the roll surface, and also the above-described effect of blocking the coating liquid can be achieved. In this case, a gap larger than 0 μm and not larger than 200 μm is more desirable. By making the upper limit of gap not larger than 200 μm, the coating liquid can surely be prevented from flowing down through the gap, so that the liquid return of coating liquid can surely be prevented.

Thus, in the present invention, it is important that even if the liquid return of excess coating liquid in the bead portion is going to occur, the liquid return be blocked immediately to prevent the coating liquid from flowing down to the lower part of gravure roll. Therefore, it is preferable that the tip end on the roll side of the inclined surface would be located at a position such that a central angle formed between a line drawn from the center of the gravure roll to a contact point at which the flexible substrate comes into contact with the gravure roll and a line drawn from the center of the gravure roll toward the tip end on the roll surface side of the inclined surface is not larger than 45°. Also, if the angle of the inclined surface of the liquid supply device is too large, the coating liquid flowing on the inclined surface is disordered, so that it is preferable that the angle of downward inclination of the inclined surface do not exceed 15° with respect to the horizontal.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

A preferred embodiment of a gravure coating apparatus in accordance with the present invention will be described with reference to the accompanying drawings.

Figure 1:
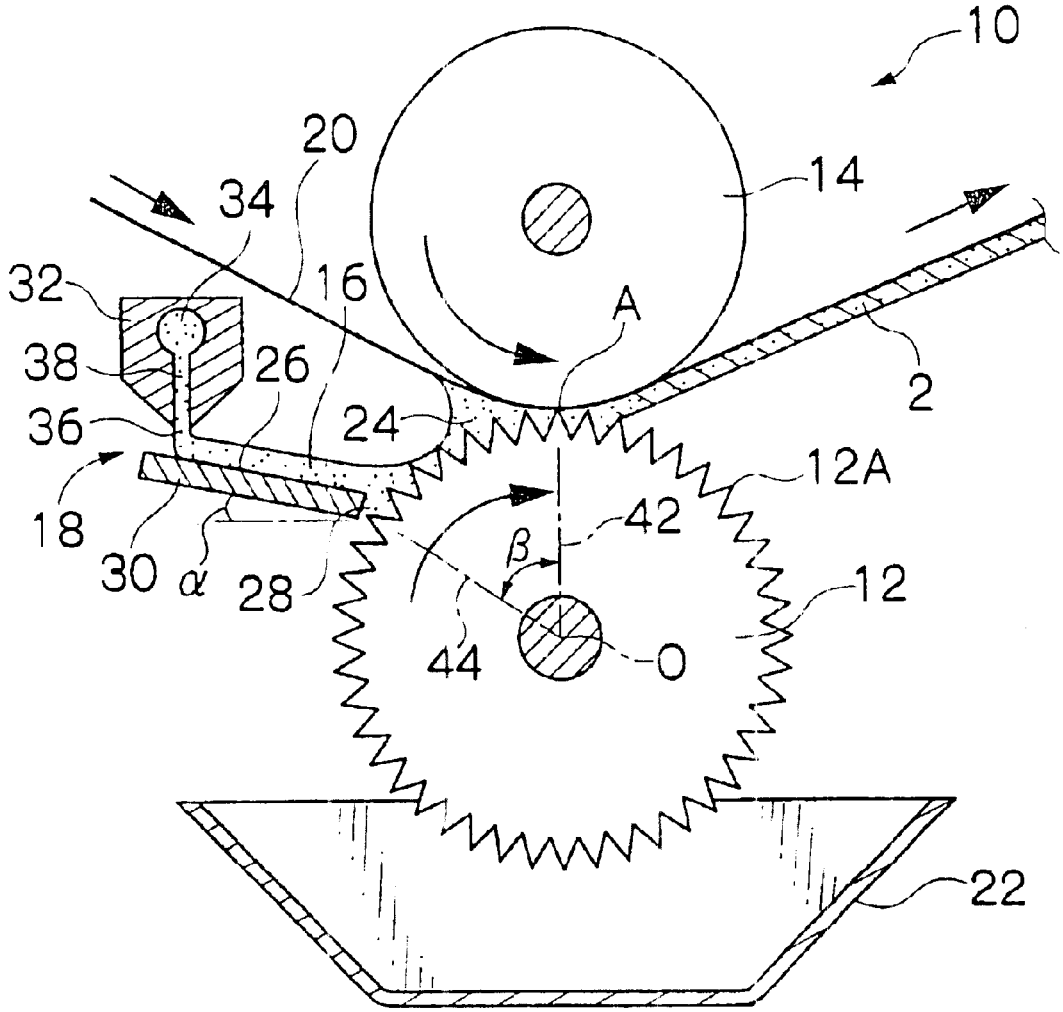
FIG. 1 is a schematic view for illustrating an embodiment of a gravure coating apparatus in accordance with the present invention, showing an example in which an extrusion type die coater and an inclined plate are used as a liquid supply device.

FIG. 1 is a schematic view for illustrating an embodiment of a general construction of a gravure coating apparatus in accordance with the present invention.

As shown in FIG. 1, a gravure coating apparatus 10 is mainly composed of a gravure roll 12, a backup roll 14, and a liquid supply device 18 for a coating liquid 16.

The gravure roll 12 has a roll surface 12A, which is engraved to stick and hold the coating liquid 16. By the rotation of the gravure roll 12, the coating liquid 16, which is supplied from the liquid supply device 18 to the roll surface 12A is transferred and applied to a continuously running web 20. Under the gravure roll 12 is provided a pan 22. This pan 22 serves to receive the coating liquid 16 dropping from the gravure roll 12, and does not serve to supply the coating liquid 16 to the gravure roll 12 unlike the conventional gravure coating apparatus. Therefore, the pan 22 does not store the coating liquid 16. The backup roll 14 is arranged adjacently on the upper side of the gravure roll 12 to press the continuously running web 20 on the gravure roll 12 in such a manner that the web 20 is held between the gravure roll 12 and the backup roll 14. While a bead portion 24 of the coating liquid 16 is formed between the roll surface 12A of the gravure roll 12 to which the coating liquid 16 is excessively supplied from the liquid supply device 18 and the continuously running web 20, the web 20 is pressed on the gravure roll 12 by using the backup roll 14, by which a desired amount of coating liquid 16 is applied to the web 20.

The liquid supply device 18 has an inclined surface 26 that is inclined downward toward the roll surface 12A, and also has a gap 28 too narrow for the coating liquid 16 to flow down between the roll surface 12A and the inclined surface 26. The liquid supply device 18 is disposed so that the inclined surface 26 is located at a position near the bead portion 24 on the upstream side in the direction of rotation of the gravure roll 12. The liquid supply device 18 is not subject to any special restriction, and may be a device that can supply the coating liquid 16 uniformly in the widthwise direction (back and face direction of FIG. 1) and can supply the coating liquid 16 to the gravure roll 12 while causing the coating liquid 16 to flow down on the inclined surface 26. The liquid supply devices 18 shown in FIGS. 1 and 2 can be used suitably.

The liquid supply device 18 shown in FIG. 1 is composed of independent members of a liquid supply portion for supplying the coating liquid 16 and an inclined portion forming the inclined surface 26. Specifically, an extrusion type die coater 32, which is the liquid supply portion, is disposed in the downward direction above an inclined plate 30 forming the inclined surface 26. In the die coater 32, a pocket portion 34 which is parallel with the inclined surface 26 in the widthwise direction is formed, and also a narrow slit 38 extending from the pocket portion 34 to a discharge port 36 is formed. The coating liquid 16 supplied to the pocket portion 34 is caused to flow so as to spread in the widthwise direction of the inclined surface 26 by the pocket portion 34, flowing down in the slit 38, and is pushed out of the discharge port 36 onto the inclined surface 26. Thereby, the coating liquid 16 is supplied uniformly in the widthwise direction of the inclined surface 26, flowing down on the inclined surface 26, and is supplied to the roll surface 12A of the gravure roll 12.

Figure 2:
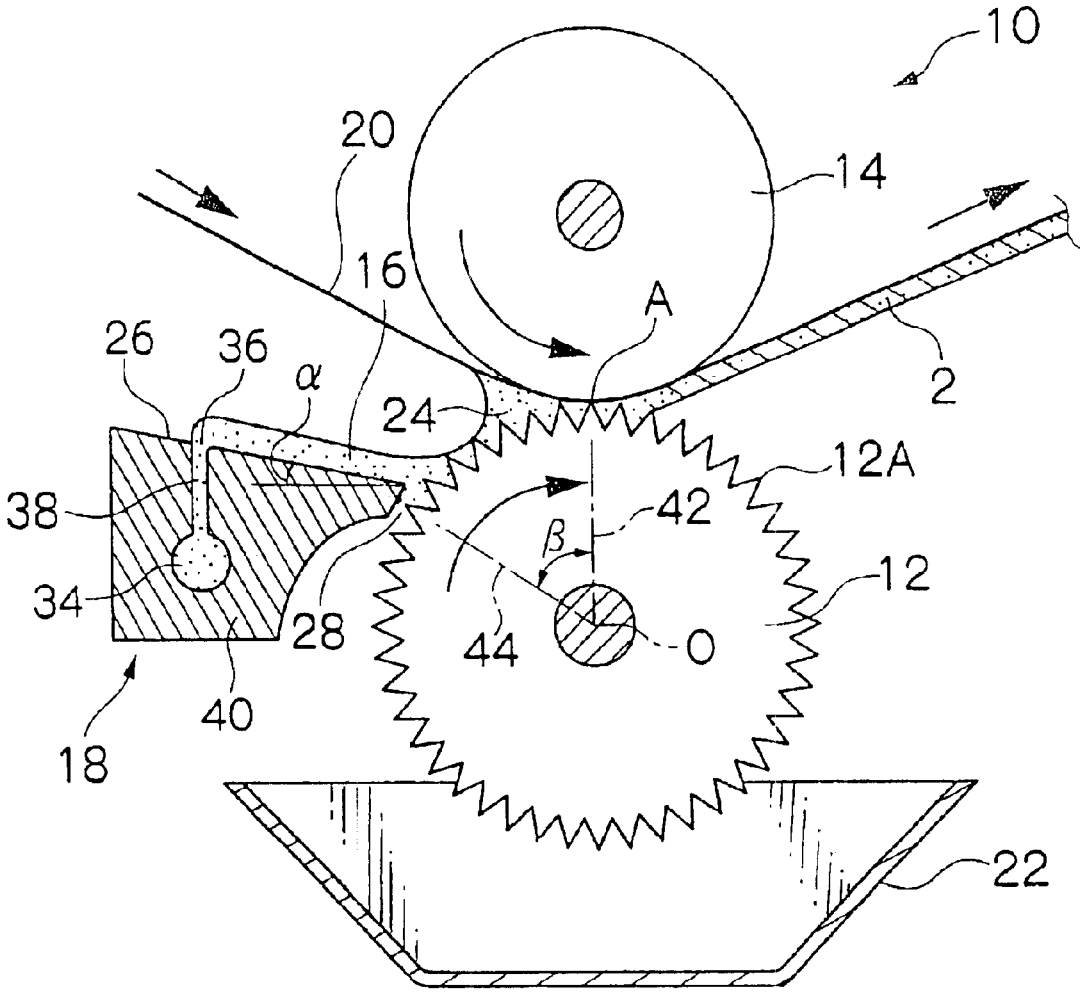
FIG. 2 is a schematic view for illustrating an embodiment of a gravure coating apparatus in accordance with the present invention, showing an example in which a slide type die coater is used as a liquid supply device.

On the other hand, the liquid supply device 18 shown in FIG. 2 is constructed so that the liquid supply portion for supplying the coating liquid 16 and the inclined portion forming the inclined surface 26 are formed integrally, by using a slide type die coater 40. This slide type die coater 40 has the inclined surface 26 on the top surface of the die coater 40 itself. Other elements such as pocket portion 34 and the slit 38 are the same as those of the extrusion type die coater 32. In this case, the coating liquid 16 having been caused to flow so as to spread by the pocket portion 34 rises in the slit 38 and is pushed out onto the inclined surface 26. Thereby, the coating liquid 16 is supplied uniformly in the widthwise direction of the inclined surface 26, flowing down on the inclined surface 26, and is supplied to the roll surface 12A of the gravure roll 12.

For both of the liquid supply devices 18 shown in FIGS. 1 and 2, a preferred position of the inclined surface 26 with respect to the roll surface 12A of the gravure roll 12 is a position such that a central angle β formed between a line 42 drawn from the center O of the gravure roll 12 to a contact point A at which the web 20 comes into contact with the gravure roll 12 and a line 44 drawn from the center O of the gravure roll 12 toward the tip end on the roll surface side of the inclined surface 26 is not larger than 45°, preferably not larger than 30°. The reason for this is that if the position of the tip end of the inclined surface 26 is too distant downward from the bead portion 24, the distance of a liquid return, which is a phenomenon that the excess coating liquid 26 that is not used for coating in the bead portion 24 flows down along the roll surface 12A, increases, so that a streak-shaped liquid return is liable to occur. Therefore, the important thing is to block the liquid return at a position near the bead portion 24. For this purpose, it is preferable that the tip end of the inclined surface 26 of the liquid supply device 18 be located at a position such that the central angle β is not larger than 45°. Further, by making the central angle β not larger than 45°, the coating liquid 16 is made in a state of riding on the upper face of the roll surface 12A and is less liable to flow down, which makes the liquid return more difficult to occur. Since it is not possible to locate the tip end of the inclined surface 26 so that the central angle β is 0°, that is, at the contact point A at which the web 20 comes into contact with the gravure roll 12, the lower limit of the central angle β is an angle such that the coating liquid 16 can be supplied physically.

Also, the angle of inclination α of the inclined surface 26 of the liquid supply device 18 does preferably not exceed 15° with respect to the horizontal, further preferably not exceed 10°. The reason for this is as follows: in order to supply the coating liquid 16 to the roll surface 12A, the inclined surface 26 must be inclined downward toward the roll surface 12A. If the angle of inclination α is too large, the flow-down speed of the coating liquid 16 flowing down on the inclined surface 26 becomes too high, so that the liquid film of the flowing-down coating liquid 16 is disordered. A trouble due to this disorder exerts an adverse influence on the application to the web 20.

Also, the gap 28 between the tip end of the inclined surface 26 and roll surface is preferably larger than 0 μm and not larger than 400 μm, further preferably larger than 0 μm and not larger than 200 μm. The reason for this is that the roll surface 12A must be prevented from being worn by avoiding the contact of the tip end of the inclined surface 26 with the roll surface 12A, and also it is important that it be difficult for the coating liquid 16 to flow down through the gap 28 to inhibit the liquid return. Therefore, if the upper limit of the gap 28 between the tip end of the inclined surface 26 and roll surface is set at a value not larger than 400 μm, the coating liquid 16 can be made difficult to flow down through the gap 28, and if the upper limit thereof is set at a value not larger than 200 μm, the coating liquid 16 scarcely flows down, so that the liquid return can be prevented surely.

EXAMPLE

Figure 3:
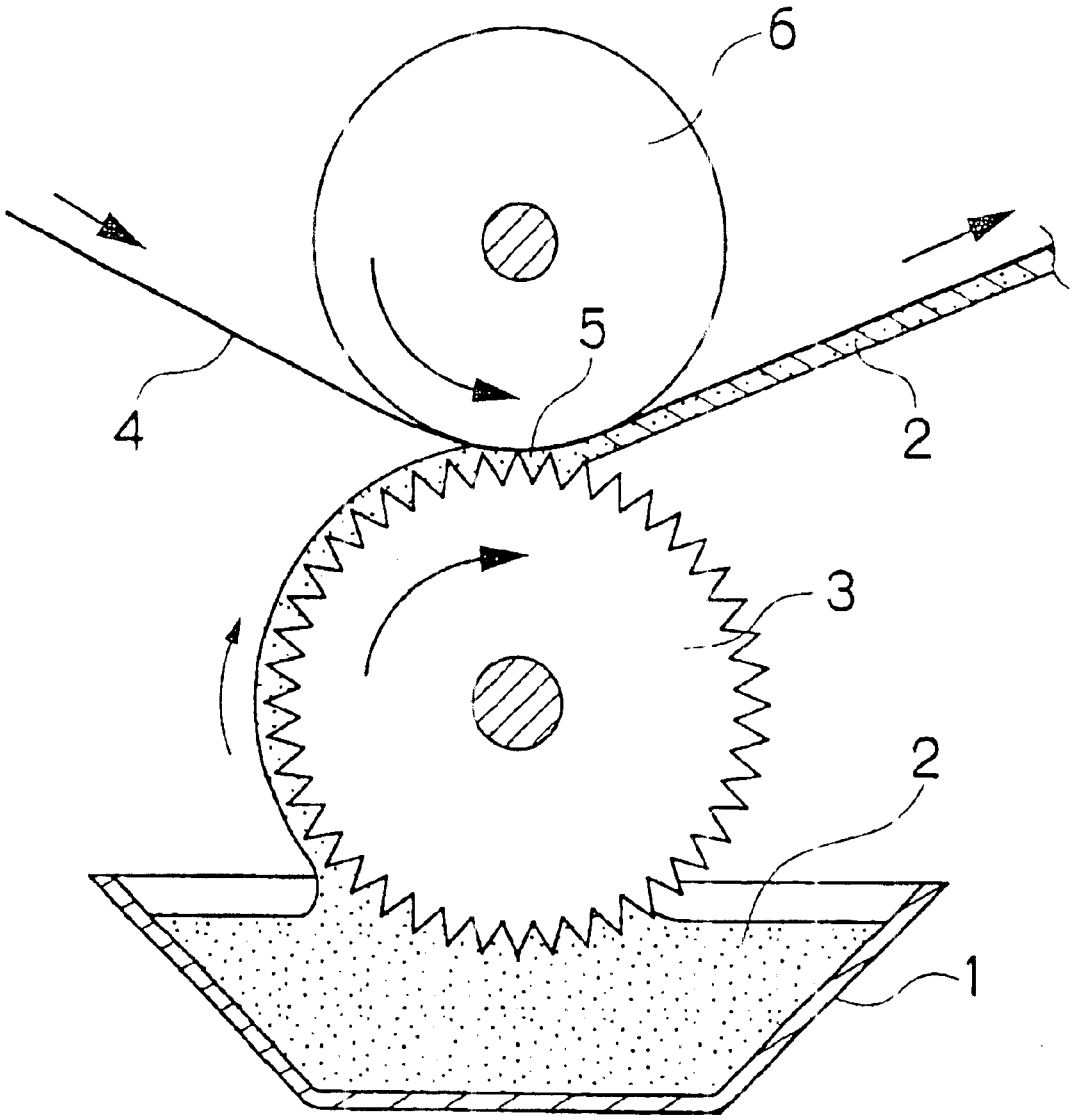
FIG.3 PRIOR ART
FIG. 3 is a schematic view of a conventional gravure coating apparatus.
Figure 4:
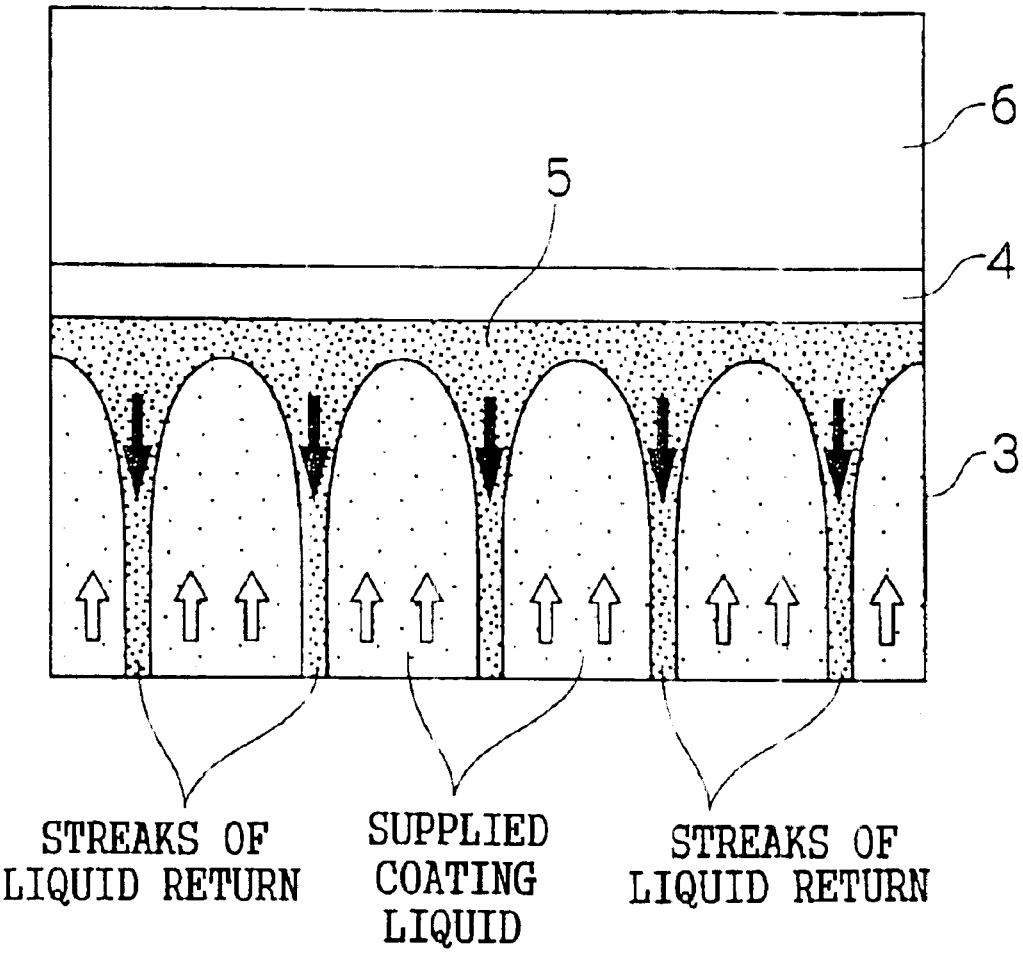
FIG. 4 is an explanatory view for illustrating a streak-shaped liquid return.

By using a web of polyethylene terephthalate (PET) of 0.1 mm thick and 1000 mm wide, coating performance of the gravure coating apparatus in accordance with the present invention shown in FIG. 1 (embodiment), the conventional gravure coating apparatus shown in FIG. 3 (comparative example 1), and the conventional gravure coating apparatus disclosed in Japanese Patent Application Publication No. 63-194766 (comparative example 2) was evaluated under the coating conditions given in Table 1.

TABLE 1

| | Coating speed | Amount of coating | Surface tension | Viscosity |
|---|---|---|---|---|
| Coating condition | 10 m/min | 4 cc/m$^2$ | 27 mN/m | 2 mPa · s |

In the test, the coating length of one time on the web was set at 100 m, and the number of streak troubles occurring in a plane shape was counted by sampling 10 m of the coating end portion. The level of occurring streak trouble was evaluated by three grades of A, B and F. A designates a streak trouble within the allowable range of product, which cannot be found unless it is observed carefully. B designates a streak trouble which is slightly more obvious than A and within the allowable range of product. F designates a streak trouble which is obvious and out of the allowable range of product. In addition, the number of liquid return streaks occurring on the gravure roll was counted visually. In the case of comparative example 2, the number of liquid return streaks occurring on the excess liquid discharge guide surface was counted. The number of liquid return streaks was counted in the third test.

Test results are given in Table 2.

TABLE 2

| | Level of streak trouble | Embodiment Number | Comparative example 1 Number | Comparative example 2 Number |
|---|---|---|---|---|
| Number of streak troubles occurring on coating surface | A | 0 | 3 | 5 |
| | B | 0 | 5 | 4 |
| | F | 0 | 13 | 3 |
| Number of liquid return streaks | | 0 | 21 | 12 |

As seen from Table 2, when the gravure coating apparatus of comparative example 1 was used for coating, of the streak troubles occurring on the coating surface, the number of streak troubles out of the allowable range of product was as large as 13, and the number of liquid return streaks was also very large, being 21.

When the gravure coating apparatus of comparative example 2 was used for coating, no liquid return was found on the roll surface of the gravure roll, but the liquid film formed a streak shape on the excess liquid discharge guide surface. Therefore, although the number of streak troubles was smaller than that of comparative example 1, three streak troubles that were out of the allowable range of product were found, which was not a satisfactory result. Also, the number of liquid return streaks occurring on the excess liquid discharge guide surface was as large as 12.

Contrarily, when the gravure coating apparatus in accordance with the present invention was used for coating, a streak trouble did not occur at all, and a liquid return streak on the roll surface was not found at all.

As described above, according to the gravure coating apparatus in accordance with the present invention, a liquid return of the excess coating liquid that is not used for coating in the bead portion is less liable to occur, so that a streak trouble on the coating surface formed on the flexible substrate can be prevented from occurring.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A gravure coating apparatus comprising:

a rotatable gravure roll;

a backup roll;

a continuously running flexible substrate arranged to pass between the backup roll and the gravure roll so that the flexible substrate is pressed on the gravure roll; and a liquid supply device arranged so as to supply the liquid to a surface of the gravure roll;

wherein the liquid supply device is disposed with respect to the gravure roll so that the liquid passes from the liquid supply device to the gravure roll at an area of the gravure roll that, during rotation of the gravure roll, is rising; and wherein the liquid supply device and the gravure roll are arranged and constructed so that, during operation, an amount of the liquid is supplied to the gravure roll sufficient to form a bead of excess said liquid between the gravure roll and the flexible substrate.

2. The gravure coating apparatus according to claim 1, wherein the liquid supply device has an inclined surface that is inclined downward toward the roll surface of the gravure roll to supply the liquid by causing the liquid to flow down on the inclined surface, and has a gap larger than 0 $\mu$m and not larger than 400 $\mu$m between an end of the inclined surface and the roll surface.

3. The gravure coating apparatus according to claim 2, wherein an angle of downward inclination of the inclined surface does not exceed 15° with respect to a horizontal.

4. The gravure coating apparatus according to claim 2, wherein the end of the inclined surface facing the roll surface is located at a position such that a central angle formed between a first line drawn from a center of the gravure roll to a contact point at which the flexible substrate comes into contact with the gravure roll and a second line drawn from the center of the gravure roll toward the end of the inclined surface facing the roll surface is not larger than 45°.

5. The gravure coating apparatus according to claim 4, wherein an angle of downward inclination of the inclined surface does not exceed 15° with respect to a horizontal.

6. The gravure coating apparatus of claim 4, wherein the angle between the first and second lines is not larger than 30°.

7. The gravure coating apparatus of claim 3, wherein the angle of downward inclination of the inclined surface does not exceed 10° with respect to a horizontal.

8. The gravure coating apparatus of claim 5, wherein the angle of downward inclination of the inclined surface does not exceed 10° with respect to a horizontal.

9. A gravure coating apparatus comprising:

a rotatable gravure roll;

means for pressing a continuously running flexible substrate on the gravure roll; and means for supplying a liquid to a surface of the gravure roll so that the liquid passes from the liquid supply means to the gravure roll at a portion of the gravure roll that is rising, and so that, during operation, an amount of the liquid is supplied to the gravure roll sufficient to form a bead of excess said liquid between the gravure roll and the flexible substrate.

10. The gravure coating apparatus according to claim 9, wherein the liquid supply means comprises an inclined surface that is inclined downward toward the roll surface of the gravure roll to supply the liquid by causing the liquid to flow down on the inclined surface, and has a gap larger than 0 $\mu$m and not larger than 400 $\mu$m between an end of the inclined surface and the roll surface.

11. The gravure coating apparatus according to claim 10, wherein an angle of downward inclination of the inclined surface does not exceed 15° with respect to a horizontal.

12. The gravure coating apparatus according to claim 10, wherein the gravure roll, the pressing means, and the liquid supply means are arranged so that the gravure roll rotates no more than 45° between a first position at which the liquid is transferred from the liquid supply means and a second position in which the flexible substrate makes contact with the gravure roll.

13. The gravure coating apparatus according to claim 12, wherein an angle of downward inclination of the inclined surface does not exceed 15° with respect to a horizontal.

14. The gravure coating apparatus according to claim 11, wherein the angle of downward inclination of the inclined surface does not exceed 10° with respect to a horizontal.

15. The gravure coating apparatus according to claim 13, wherein the angle of downward inclination of the inclined surface does not exceed 10° with respect to a horizontal.

16. The gravure coating apparatus according to claim 12, wherein the gravure roll, the pressing means, and the liquid supply means are arranged so that the gravure roll rotates no more than 30° between the first position and the second position.

17. The gravure coating apparatus according to claim 12, wherein the gravure roll, the pressing means, and the liquid supply means are arranged so that a path traveled by the liquid on the surface of the gravure roll between the first position and the second position at no time includes a downward component.

* * * * *